US005246170A

United States Patent [19]

Woidt

[11] Patent Number: 5,246,170

[45] Date of Patent: Sep. 21, 1993

[54] SELF CLEANING EMITTER

[76] Inventor: Rienhold W. Woidt, 53 Edith Terrace, Balaklava, South Australia, Australia

[21] Appl. No.: 847,771

[22] Filed: Mar. 5, 1992

[30] Foreign Application Priority Data

Mar. 8, 1991 [AU] Australia ..... PK 5007

[51] Int. Cl.[5] ..... B05B 1/26; B05B 15/00

[52] U.S. Cl. ..... 239/520; 239/524; 239/542; 239/547; 239/596; 239/602; 239/DIG. 12

[58] Field of Search ..... 239/546, 596, 602, DIG. 12, 239/518, 542, 547, 510, 524, 499

[56] References Cited

U.S. PATENT DOCUMENTS

| | | | |
|---|---|---|---|
| 1,427,822 | 9/1922 | Kennedy et al. | 239/518 |
| 1,520,048 | 12/1924 | Baird | 239/547 |
| 1,636,314 | 7/1927 | Murray | 239/602 |
| 2,392,085 | 1/1946 | Ferrel | 239/602 |
| 2,778,685 | 1/1957 | Umbricht | 239/518 |
| 3,273,804 | 9/1966 | Wilson | 239/602 |
| 3,288,371 | 11/1966 | Broughton | 239/602 |
| 3,351,292 | 11/1967 | Stuart, Sr. | 239/602 |
| 3,870,236 | 3/1975 | Sahagun-Barragan | 239/542 |
| 3,896,995 | 7/1975 | Barragan | 239/107 |

FOREIGN PATENT DOCUMENTS

| | | | |
|---|---|---|---|
| 473138 | 11/1974 | Australia . | |
| 90/14893 | 12/1990 | World Int. Prop. O. | 239/602 |

*Primary Examiner*—Andres Kashnikow
*Assistant Examiner*—Christopher G. Trainor
*Attorney, Agent, or Firm*—Brown, Martin, Haller & McClain

[57] ABSTRACT

An emitter is provided with a flexible diaphragm of elastomeric material containing at least two slits which radiate outwardly from a point near the center of the diaphragm, the diaphragm being assembled in the emitter body in the manner of a gasket, and the diaphragm having characteristics of durometer hardness and flexibility such than when in use the diaphragm is distended and the slits open to establish an orifice which allows an outflow of irrigating water at a low discharge rate, but when the pressure is removed the resilience of the diaphragm closes, the faces become contiguous and close the orifice, thereby preventing ingress of insects and egress of moisture.

4 Claims, 1 Drawing Sheet

SELF CLEANING EMITTER

This invention relates to an emitter which is useful for irrigation purposes, more particularly for drip irrigation purposes, and which embodies a self-cleaning feature.

BACKGROUND OF THE INVENTION

The main single difficulty which is encountered with irrigation emitters is the tendency for the emitters to block with insects, sand, mud, slime and decaying vegetable matter. In order for the emitter discharge to be slowed it is necessary to limit the size of an orifice or to incorporate a labyrinth conduit upstream of the orifice so that the flow rate is slow. In both instances, however, there is a tendency for blockage to occur due to deposition of solid or semi-solid particles, and although the cost of an emitter is small, the loss to a grower can be considerable since an emitter which fails to work but which is not readily identifiable can result in the loss of a valuable plant.

Various attempts are known to have been made in providing a self-cleaning facility within the design of an emitter, but as far as is known the difficulties which have been encountered heretofore have not been completely overcome and the attempts which have been made have not been persevered with.

PRIOR ART

The closest prior art known to the Applicant is the now expired Australian patent 473138 (Smith & Bowen), based on U.S. application No. 257780, May 30, 1972.

In that specification, use was made of a series of flow controlling elements in an emitter, each control element being an elastomeric membrane or diaphragm having a central aperture of about 1/32 inch (1 mm) diameter. As pressure differential across a diaphragm increased, the walls defining the orifice stretched and orifice size increased. Thus if an obstruction occurred in one orifice, reduced flow caused pressure difference across an unobstructed downstream orifice to atmosphere to be reduced, with consequential increase in pressure differential across the diaphragm having the blocked orifice.

Other relevant prior art is disclosed in Australian specifications 471125 and 453775, and U.S. specifications 4008853; 4174067 and 4958772. Applicant has no knowledge of any prior art wherein increase of pressure differential across a diaphragm caused slits to open into an orifice, but close again upon loss of pressure.

BRIEF SUMMARY OF THE INVENTION

In an embodiment of this invention however an emitter is provided with a flexible diaphragm of elastomeric material containing at least two slits which radiate outwardly from a point near the centre of the diaphragm, the diaphragm being assembled in the emitter body in the manner of a gasket, and the diaphragm having characteristics of durometer hardness and flexibility such that when in use the diaphragm is distended and the slits open to establish an orifice which allows an outflow of irrigating water at a low discharge rate, but when the pressure is removed the resilience of the diaphragm closes, and the faces become contiguous and close the orifice, thereby preventing ingress of insects and egress of moisture. It also prevents evaporation so that build up of hard semi-soluble substances such as salts at the emitting locality is also inhibited.

Experimental work which has been undertaken with respect to the invention indicates an improvement over all prior art known to the applicant.

Thus the invention may be said to consist of an irrigation emitter comprising a first wall defining a water inlet conduit, a second wall defining an outlet opening, an elastomeric diaphragm having a periphery, contiguous faces defining at least two slits extending through the diaphragm and intersecting near the centre of the diaphragm, and surfaces on respective said walls sealably engaging the diaphragm periphery and retaining the diaphragm between said walls, the elastomeric characteristics of the diaphragm being such that under conditions of fluid pressure differential across the diaphragm the slit defining faces deform to establish an orifice but under conditions of no fluid pressure differential lie in close proximity so as to close said orifice.

It will be seen that the invention needs to comprise only three parts, all of which are very inexpensive to produce, but the diaphragm elastomer can be chosen to provide sufficient distortion under normal pressure to allow the surfaces defining the slits to not only separate but also to change angular position, such that when there is no pressure across the diaphragm the resilience will cause the slit faces to once again come in contact with one another in a motion which embodies both movement towards one another in a radial plane and at the same time reduction of divergence angle between those faces.

BRIEF DESCRIPTION OF THE DRAWINGS

An embodiment of the invention is described hereunder in some detail with reference to and as illustrated in the accompanying drawings in which.

Figure 3:
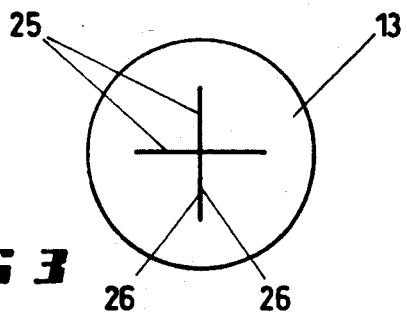
FIG. 3 is a top view of the diaphragm.
Figure 1:
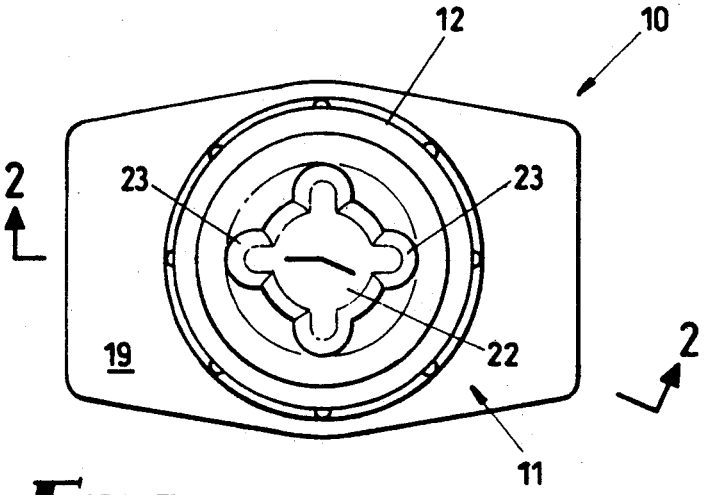
FIG. 1 is a top view of an emitter according to the invention.

In this embodiment, a self-cleaning emitter 10 comprises three parts, there being a body 11, a cap 12, and between the two an elastomeric diaphragm 13.

The body 11 comprises an annular cup-like portion 15 which has an outer male thread 16 and it terminates at its outer end in a flat annular surface 17. It is also provided with a tail 18 which as illustrated, has a thread, although a barb may be used, and the tail is also hollow and is co-axial with the cup-like portion 15. A flange 19 is located between the tail 18 and the cup-like portion 15.

The cap 12 is a generally annular member having a skirt 20 with internal thread by which it is fastened to the body 11 when it threadably engages the male thread 16, and the cap 12 has an internal annular shelf 21 which bears against the upper surface of the periphery of diaphragm 13, while the lower surface of the diaphragm periphery bears against the flat annular surface 17. Water flow outlets exist between a deflector disc 22 and the main body of the cap 12, the deflector disc 22 being displaced away from the outer end of the main body by four legs 23 to provide four openings which under normal operation would cause any outflow of water to be divided into four different streams, thus slightly spreading the water flow over the surface of soil which is penetrated thereby.

Figure 4:
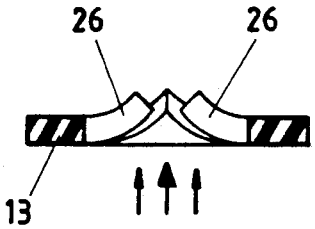
FIG. 4 is a section showing deformation of the diaphragm faces when an orifice is established.
Figure 2:
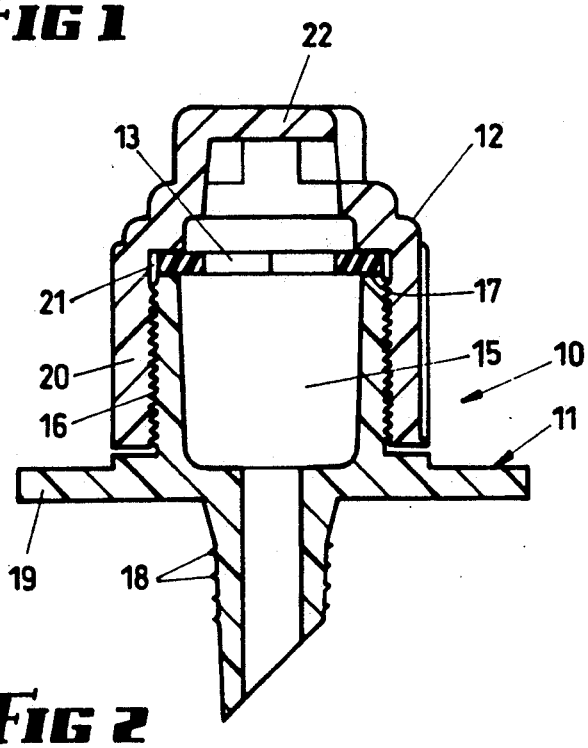
FIG. 2 is a section taken on line 2—2 of FIG. 1.

The diaphragm 13 is provided with two intersecting slits 25, each slit comprising two faces 26 which, under non-use conditions, lie contiguous with one another and inhibit evaporation, but when sufficient pressure is applied to cause emission of water in an irrigation system, the diaphragm distorts outwardly as shown in FIG. 4 towards the cap 22 and in so doing the contiguous faces of the slits 26 both separate and diverge upwardly to establish an orifice. In the unlikely event of blockage occurring, this action tends to open out the blockage material, and if the blockage is serious, a slight increase of pressure will cause a corresponding increase of distortion of the diaphragm which will result in turn in further opening of the slit walls away from one another. As soon as pressure is reduced however, the resilience of the diaphragm will cause the slit faces to close towards one another and this gives some degree of wiping action which is found to be self-cleaning, it inhibits ingress of insects such as small ants, and it also inhibits excessive evaporation at the discharge locality.

Many variations of course will be seen to lie within the invention and for example, the diaphragm need not be a flat discoid member as illustrated but could itself be a short length of tube with a domed end, it is not necessary for the discharge to incorporate the deflector disc 22 in certain instances, this further simplifying the shape of the cap and reducing cost, and in some instances, use can be made of a discoid closure member contiguous with, or alternative to, the diaphragm which inhibits moisture discharge from within the cup-like portion when that is not required. The tail 18 is shown as a threaded tail which is tapered and provides an excellent interconnection with a smooth walled aperture of a pipe network. However, the tail may be barbed.

Figure 5:
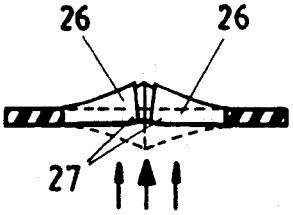
FIG. 5 is a section through an elastomeric diaphragm shaped to limit excessive liquid flow if the pressure increases.

Sometimes an irrigation distribution line has emitters located at different levels, so that the pressure differential across the diaphragms vary. If in-line pressure compensators are used, the differences in emission rates can be reduced. However, the invention provides a facility to achieve some degree of compensation if the depth of the slit faces is large, and while FIG. 4 shows a diaphragm of constant wall thickness, FIG. 5 shows how an increase in wall thickness at the centre of the diaphragm will cause the heels 27 of the deforming portions between the faces 26 to close upon excessive distortion.

I claim:

1. An irrigation emitter comprising an annular cup-like body having an external thread, a cap having an internally threaded skirt engaging said external thread thereby releasably retaining the cap to the body, a deflector, and spacer means for spacing the deflector away from the skirt, the spacer means defining water flow outlets between the deflector and skirt, an elastomeric diaphragm having a periphery, contiguous faces defining at least two slits extending through the diaphragm and intersecting near the centre of the diaphragm, and surfaces on said body and skirt sealably engaging the diaphragm periphery, and retaining the diaphragm between said body and skirt, the elastomeric characteristics of the diaphragm being such that water pressure within the body establishes a fluid pressure differential across the diaphragm which deforms the slit defining faces to establish an orifice through which water flows to be discharged through said outlets, but under conditions of no fluid pressure differential said faces lie in close proximity so as to close said orifice.

2. An irrigation emitter according to claim 1 wherein said cup-like body comprises a flange at one end and a hollow tail projecting from the flange.

3. An irrigation emitter according to claim 1 wherein said diaphragm is of constant thickness.

4. An irrigation emitter according to claim 1 wherein said diaphragm has a thickness which increases to its centre.

* * * * *